US005557960A

United States Patent [19]

Hoffmann et al.

[11] Patent Number: 5,557,960

[45] Date of Patent: Sep. 24, 1996

[54] DEVICE FOR PRODUCING A TUBE, IN PARTICULAR A TUBE-SHAPED PRINTING FORM, WITH A CONTINUOUS CIRCUMFERENTIAL SURFACE

[75] Inventors: Eduard Hoffmann, Bobingen; Johann Winterholler, Friedberg; Wolfgang Prem, Ustersbach, all of Germany

[73] Assignee: MAN Roland Druckmaschinen AG, Offenbach, Germany

[21] Appl. No.: 222,695

[22] Filed: Apr. 4, 1994

[30] Foreign Application Priority Data

Apr. 3, 1993 [DE] Germany ..... 43 11 078.9

[51] Int. Cl.[6] ..... B21D 39/02; B21D 51/28; B21D 11/02

[52] U.S. Cl. ..... 72/51; 72/295; 72/166

[58] Field of Search ..... 72/51, 133, 166, 72/169, 295, 298, 301, 401; 228/151

[56] References Cited

U.S. PATENT DOCUMENTS

| | | | |
|---|---|---|---|
| 2,958,361 | 11/1960 | Hunter | 72/301 |
| 3,773,594 | 11/1973 | Aaron et al. | 156/299 |
| 3,937,052 | 2/1976 | Hoexter et al. | 72/166 |
| 4,674,165 | 6/1987 | Späth | 72/301 |
| 4,708,573 | 11/1987 | Hug | 72/422 |
| 4,922,742 | 5/1990 | Syrylo, Jr. et al. | 72/465 |
| 4,970,888 | 11/1990 | Shiraishi et al. | 72/422 |

FOREIGN PATENT DOCUMENTS

| | | |
|---|---|---|
| 3532099 | 3/1987 | Germany . |
| 4140768 | 6/1993 | Germany . |

OTHER PUBLICATIONS

Patent Abstracts of Japan–Publication No. JP58074357; Publication date May 4, 1983.

*Primary Examiner*—Lowell A. Larson
*Assistant Examiner*—Rodney Butler
*Attorney, Agent, or Firm*—Cohen, Pontani, Lieberman, Pavane

[57] ABSTRACT

A device for producing a tube-shaped printing form from a plate with a register hole system. A clamping strip which can be supported in its initial position and fastened to the respective plate edge longitudinally is provided for each edge of the plate to be connected. The clamping strips have a pin register which is designed in so that the pins can cooperate with the register hole system of the plate. A mechanism is assigned to one of the strips for effecting a rotation around an axle parallel to its longitudinal axis. The strips can be positioned opposite one another by this rotation and the plate edges clamped at the strips contact one another and can be connected for the purpose of forming a tube.

11 Claims, 6 Drawing Sheets

DEVICE FOR PRODUCING A TUBE, IN PARTICULAR A TUBE-SHAPED PRINTING FORM, WITH A CONTINUOUS CIRCUMFERENTIAL SURFACE

BACKGROUND OF THE INVENTION

1. Field of the Invention

The invention is directed to a device for producing a tube, in particular a tube-shaped printing form, with a continuous circumferential surface, from a plate with a register hole system.

2. Discussion of the Prior Art

The prior German Patent Application P 41 40 768 discloses a tube-shaped offset printing form which has a continuous circumferential surface without gaps and can be slid onto a form cylinder and positioned thereon in a working position in a frictionally locking manner and in correct register. The tube is produced from a commercially available printing plate of metallic work material which is cut to size. The beginning and end edges of the plate are connected, e.g. welded, with one another in such a way that the tube has an uninterrupted circumferential surface with the exception of the connecting seam. In addition, the printing plate is provided with a register hole system so that it can be clamped in a welding device in the correct position and seam-welded along its length.

The clamping of the plate in the correct position and the forming of the plate into a tube were formerly carried out by cumbersome manual labor. There is no known device in which it is required only that the cut plate be inserted and in which the curving or rolling process and positioning of the ends of the plate in exact register are achieved for the connection after the insertion of the plate.

SUMMARY OF THE INVENTION

Accordingly, it is an object of the present invention to provide a device for producing a tube form from cut plates, in particular offset printing plates, and for joining the edges of the plate from the beginning to the end of the plate in exact register.

Pursuant to this object, and others which will become apparent hereafter, one aspect of the present invention resides in producing the tube from a plate having register holes therein. Clamping strips are supported in an initial position and are fastened to respective edges of the plate, longitudinally. A separate clamping strip is provided for each edge of the plate which is to be connected together to form the tube. The clamping strips have a pin register with pins that cooperate with the register holes of the plate. At least one of the clamping strips has means for rotating around an axle. The clamping strips are positioned opposite one another as a result of the rotation so that the plate edges clamped at the strips contact one another and can be connected together to form the tube.

In another embodiment of the invention, the clamping strips are fastened at a distance from one another in the initial position, approximately in a common plane, by holders which are positioned corresponding to the size of the plate. A sliding table, on which the plate to be formed is placed, is provided under the holders. The clamping strips can be lowered onto the plate by lifting elements provided at the holders. The plate edges to be connected can be fixed at the strips by the pin register and the register hole system while simultaneously detaching from the holders. One of the clamping strips is displaceable transversely along the sliding table at least along the length of the plate while the other clamping strip, including the plate edge fixed thereto is positionable on a rotatably supported cylinder so that the plate is wrapped around the cylinder after a complete revolution of the cylinder. An additional holder is arranged to hold the strip that is displaced along the sliding table after displacement takes place.

In yet another embodiment of the invention, the clamping strip which is displaced over the sliding table is constructed as a carriage that can be pulled along the table in a slide guide and brought back into its initial position by an endless conveyor chain which is guided by cam rollers.

In still another embodiment of the invention the diameter of the cylinder can be adjusted by means of a connecting link.

Yet a further embodiment provides that the endless conveyor chain is guided over the cylinder and is arranged at a distance from the cylinder that corresponds at least to the length of the pins.

In still yet a further embodiment of the invention the clamping strip which is displaceable over the table is resiliently supported in sliding rails.

In a further embodiment of the invention the cylinder is supported eccentrically relative to its drive.

In still a further embodiment of the invention the cylinder is movable below and parallel to the plane in which the clamping strips are arranged so that the cylinder moves the plate down and the plate is wrapped around the cylinder. The cylinder has a circumference that is somewhat smaller than the length of the plate.

In another embodiment of the invention a driving pinion and a toothed rack are provided to move the cylinder while simultaneously rotating it.

In still another embodiment of the invention the cylinder has a flattened shoulder for positioning the plate edges.

In yet a further embodiment of the invention the clamping strips are suction strips which integrated vacuum suction members which are distributed at a slight distance from one another along the entire length of each strip. It is also possible to construct the clamping strips as magnetic strips that frictionally lock with the plate edges when magnetizable plates are used.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
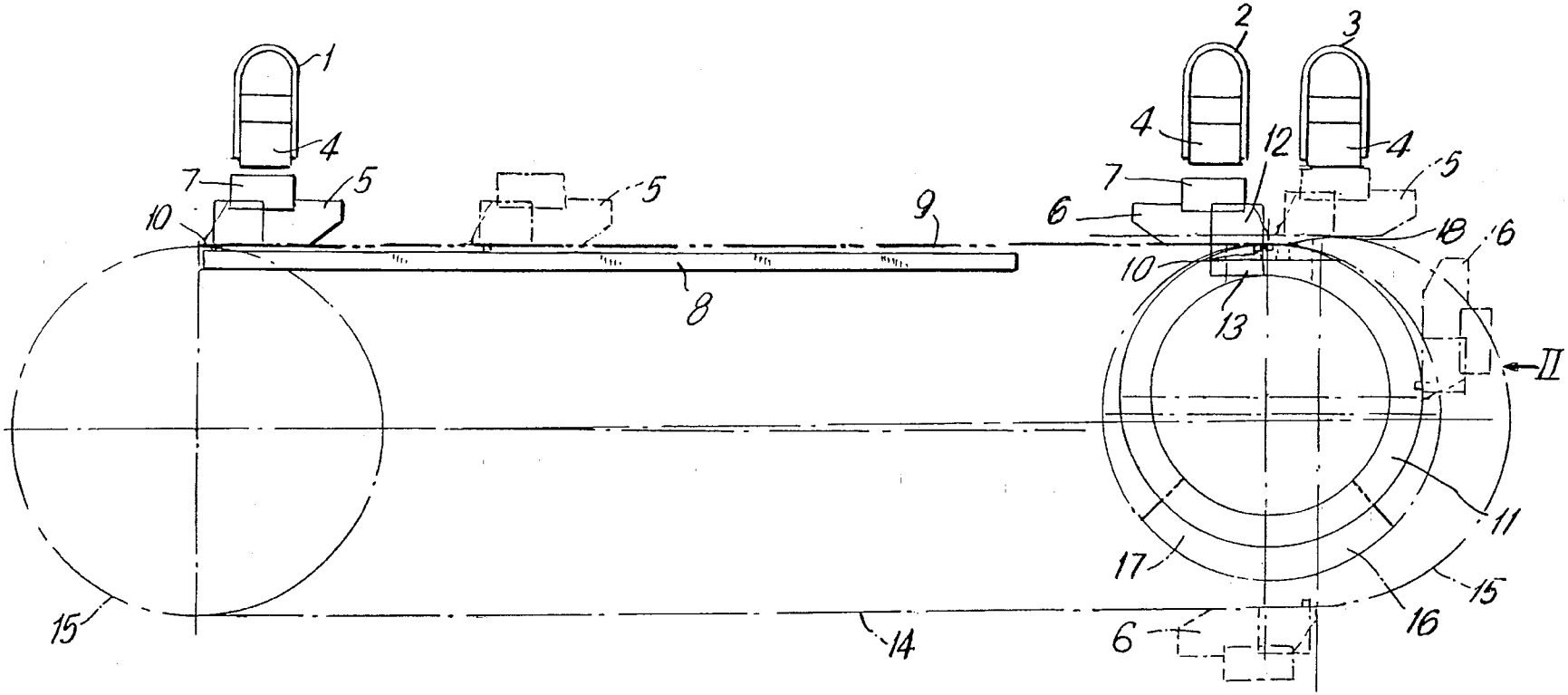
FIG. 1 is a side view of a first embodiment example of a device according to the invention.
Figure 2:
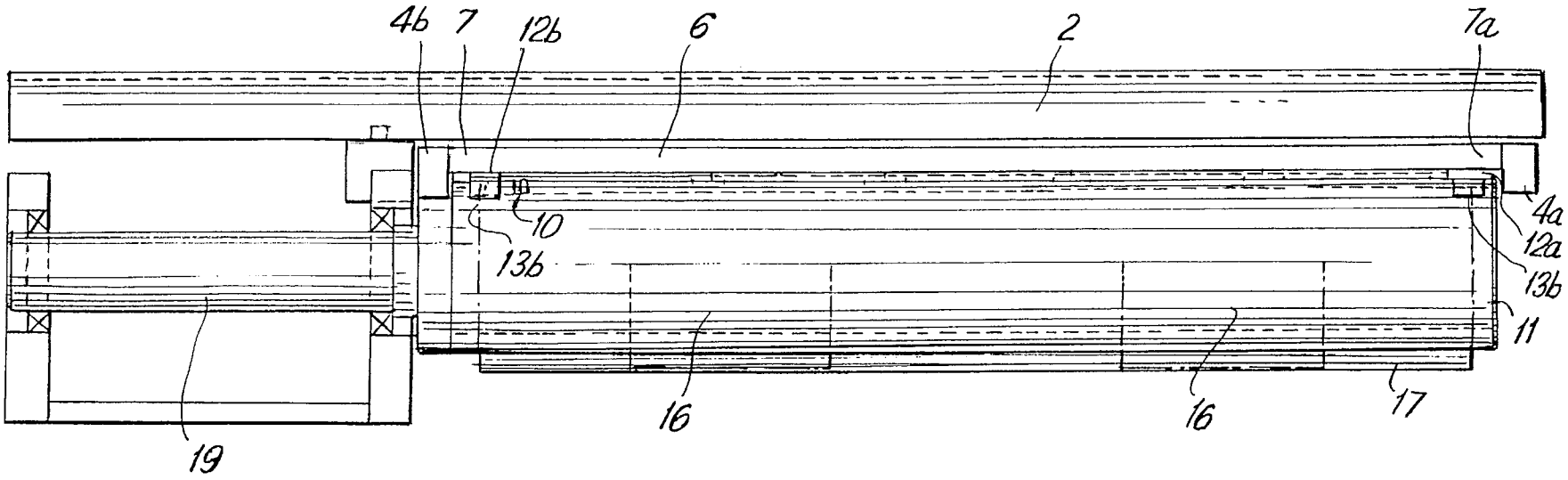
FIG. 2 is a view of the first embodiment in direction II according to FIG. 1.

In the first embodiment according to FIGS. 1 and 2, three girder-shaped holders 1, 2, 3 are arranged along the full width of the device in a plane. Each holder 1, 2, 3 has one or more lifting elements 4 which are distributed along each holder 1, 2, 3 and are constructed as electric clamping magnets.

The positioning of the holders 1, 2, 3, which can be carried out corresponding to the size of the plate employed, can be effected in a known manner, which is therefore not shown in the drawing, in that the holders 1, 2, 3 are supported on rails and can be fastened at optional locations. Two of the holders 1, 2 are disposed at a distance from one another corresponding to the plate length, each of them holding a clamping strip 5, 6 in the initial position in that the lifting elements 4, which are constructed as clamping magnets, cooperate with soft-iron cores 7 arranged on the strips 5, 6 in a corresponding manner.

A sliding table 8, on which is placed the plate 9 to be formed (dashed lines), is provided below the holders 1, 2, 3 but the region below a strip 6 is left open.

The two strips 5, 6 can be lowered on the plate 9 by means of the lifting elements 4 which are hydraulically or pneumatically actuated, for example, and the edges of the plate to be connected can be fixed at the strips 5, 6 in exact register by means of a pin register 10 of the strips 5, 6 and the register-hole system of the plate 9. The arrangement of the pins 10 on the strips 5, 6 is effected so that the printing plate 9 which is provided with suitably punched perforations can be fixed in exact register. All holes are so disposed within the plate edges that the holes lie outside the printing surface when the plate 9 is bent.

One strip 5 has the sliding table 8 as an abutment while the other strip 6 engages at the plate edge extending beyond the sliding table 8. A rotatably supported cylinder is provided below this edge as a counter-bearing for this plate edge. In addition, the strip 6 which can be lowered, including the plate edge fixed thereto, can be positioned on the cylinder 11 by means of clamping magnets 12. These clamping magnets 12 are arranged on the strip 6 (on both sides of the strip 6 in the present example) and cooperate with correspondingly arranged soft-iron cores 13 on the cylinder 11 or vice versa.

After disengaging the holders 1, 2 from the strips 5, 6, only one strip 6 still sits on the cylinder 11, while the other strip 5 is displaceable along the sliding table 8.

In the particularly advantageous construction shown in the drawing, the transversely displaceable strip 5 is constructed as a carriage and can be pulled along the table 8 in a slide guide, not shown, and brought into its initial position again, respectively, by means of at least one endless conveyor chain 14 which is guided along guide rollers or cam rollers 15 and supported by chain guides, not shown.

In an advisable construction, not shown, the displaceable strip 5 is resiliently supported at both sides in U-shaped rails and this resiliency defines the lifting path of the strip 5 in the movement direction of the lifting elements 4 of the holder 1, 3. The conveyor chain 14 can also be guided in these rails on the path along the sliding table 8.

In a particularly advisable manner, the endless conveyor chain 14 and also the transversely displaceable strip 5 can be guided over the cylinder 11 while maintaining a distance therefrom amounting at least to the length of the pin 10 so as to move over the cylinder 11 without making contact.

The cylinder 11 is advantageously constructed with a variable diameter so that different plate formats can be used. A connecting link 16 which can be moved in and moved out is provided for this purpose. This connecting link 16 may be formed by a plurality of individual extensible segments distributed along the cylinder or by inflatable regions on the circumference of the cylinder 11. Accordingly, the cylinder 11 may be provided within certain limits with a circumference which is somewhat larger than the length of the plate to be processed.

When the plate 9 is placed on the sliding table 8, the clamping strips 5, 6 are lowered onto the plate edges from the initial position and the plate edges are fixed at the strips 5, 6 by means of the register hole system and pin register 10. The strip 6 is connected in a frictionally locking manner with the cylinder 11 by the electric clamping magnets 12 arranged at both sides, and the two strips 5, 6 are detached from the holders 1, 2. The cylinder 11 is rotated by 360° so that the tube form 17 is produced, while the strip 5 together with the plate edge fixed thereto is pulled along the sliding table 8 and over the cylinder 11. When the cylinder 11 is rotated, the strip 5, including the plate edge attached thereto, is located below the third holder 3 and can be positioned on the cylinder 11 in a manner similar to the other strip 6 by means of the lifting elements 4 of this holder 3.

The cylinder 11 advantageously has a flattened shoulder 18 at these positioning locations.

The positioning of the plate edges on the form cylinder 11 can be additionally reinforced in an advantageous manner by providing the cylinder with elongated register holes in which the register pins 10 of the strips 5, 6 can engage through the plate edges.

When the connecting link 16 is moved in and relieved of pressure and the circumference of the cylinder 11 is accordingly reduced, one strip 5 can be displaced toward the other strip 6 until the plate edges contact and the plate edges can be connected or a welding process can be effected.

Another advantageous feature is that the cylinder 11 is supported eccentrically relative to its drive 19 in order to compensate for the difference between its minimum and maximum diameter brought about by the connecting link 16.

Figure 3:
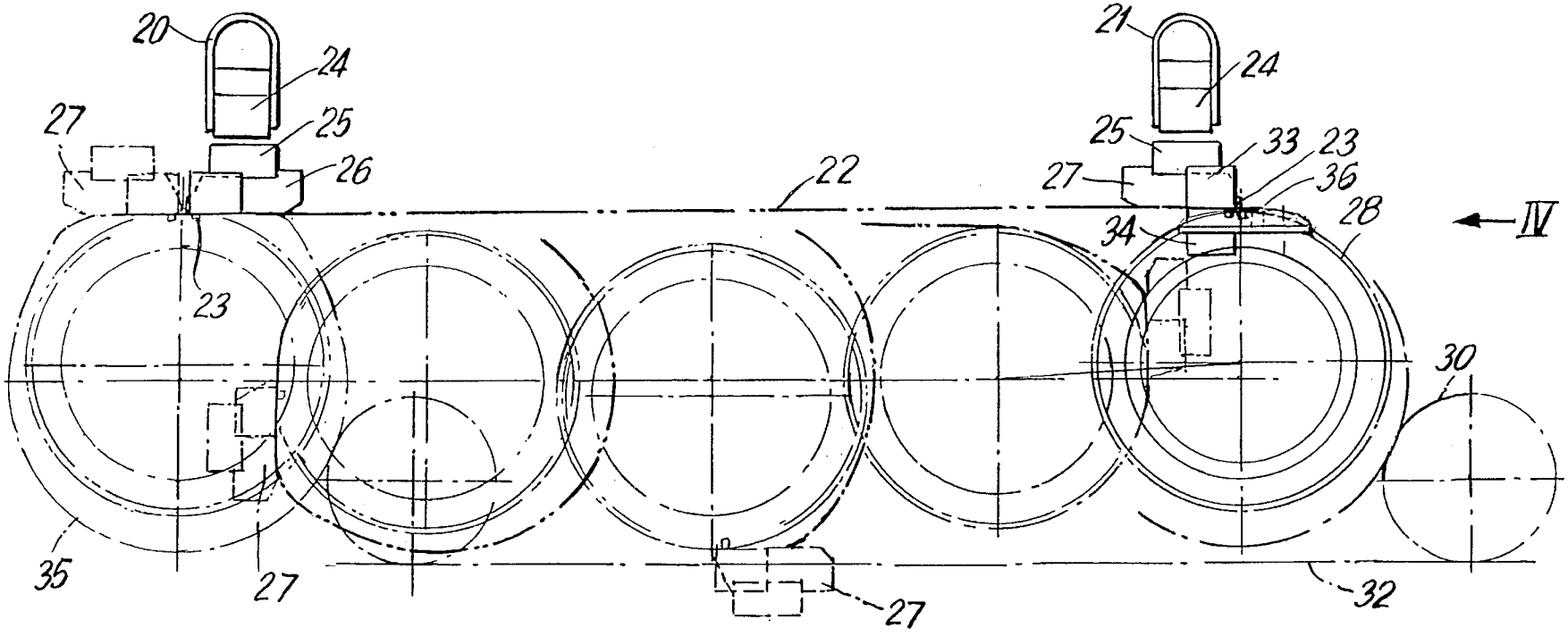
FIG. 3 is a side view of a second embodiment example of a device according to the invention.
Figure 4:
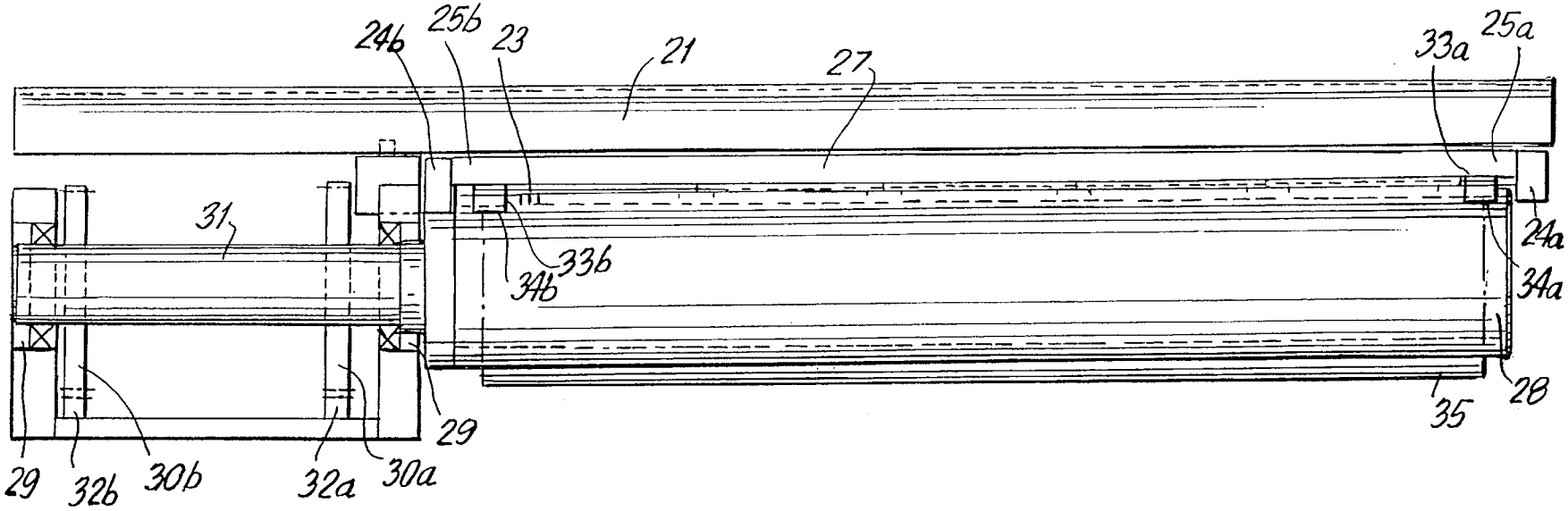
FIG. 4 is a view of this second embodiment in direction IV according to FIG. 3.

A second embodiment is shown in FIGS. 3 and 4. Two holders 20, 21 are positioned, in the same way as in the first embodiment example, in accordance with the size of the plate to be processed and the plate edges of the printing plate 22 (dashed lines) which are to be connected can be fastened, as described in the first embodiment example, by means of the pin register 23 and the register hole system at the two clamping strips 26, 27 which are fixed at the two holders 20, 21 by means of lifting elements 24 in the form of clamping magnets and by means of soft-iron cores 25 arranged in a suitable manner.

A rotatably supported cylinder 28 is arranged below the holder 21. The cylinder 28 is displaceable transversely parallel to the plane in which the holders 20, 21 are arranged. For this purpose, the cylinder 28 is supported in a rail 29, and driving pinions 30 which act on the bearing axle 31 of the cylinder 28 roll on toothed racks 32 enabling a transverse and circumferential movement simultaneously.

The cylinder 28 has a somewhat smaller circumference than the shortest length of the plates 22 to be processed.

One of the strips 27, along with the plate edge fastened thereto, can be positioned by means of the lifting elements 24 of its holder 21 on the cylinder 28 arranged below the latter. The strip 27 is held on the cylinder 28 by electric clamping magnets 33 and soft-iron cores 34 cooperating with the latter, while the holder 21 releases the strip 27, but the other strip 26, along with the plate edge fastened to it, remains at its holder 20.

The cylinder 28 is now moved in the direction of the stationary strip 26 by means of a drive, the driving pinions 30 and toothed racks 32. In so doing, it executes a rotation of 360° and moves the plate 22 down so that the plate 22 is wrapped around it, thus producing the tube form 35. After a complete revolution of the cylinder 28, the clamping strips 26, 27 are located opposite one another until the plate edges to be connected contact one another.

In this position of the cylinder 28, the second strip 26 along with the plate edge fixed thereto can be positioned on the cylinder 28 by means of the lifting elements 24 of the holder 20 and the connection of the plate edges or welding process can be effected.

This cylinder 28 is also advantageously outfitted with a flattened shoulder 36 for positioning the plate edges.

Another feature is that the cylinder 28 is supported eccentrically relative to its drive so that the plate 22 can move down (FIG. 3) so as to be offset vertically.

Figure 5:
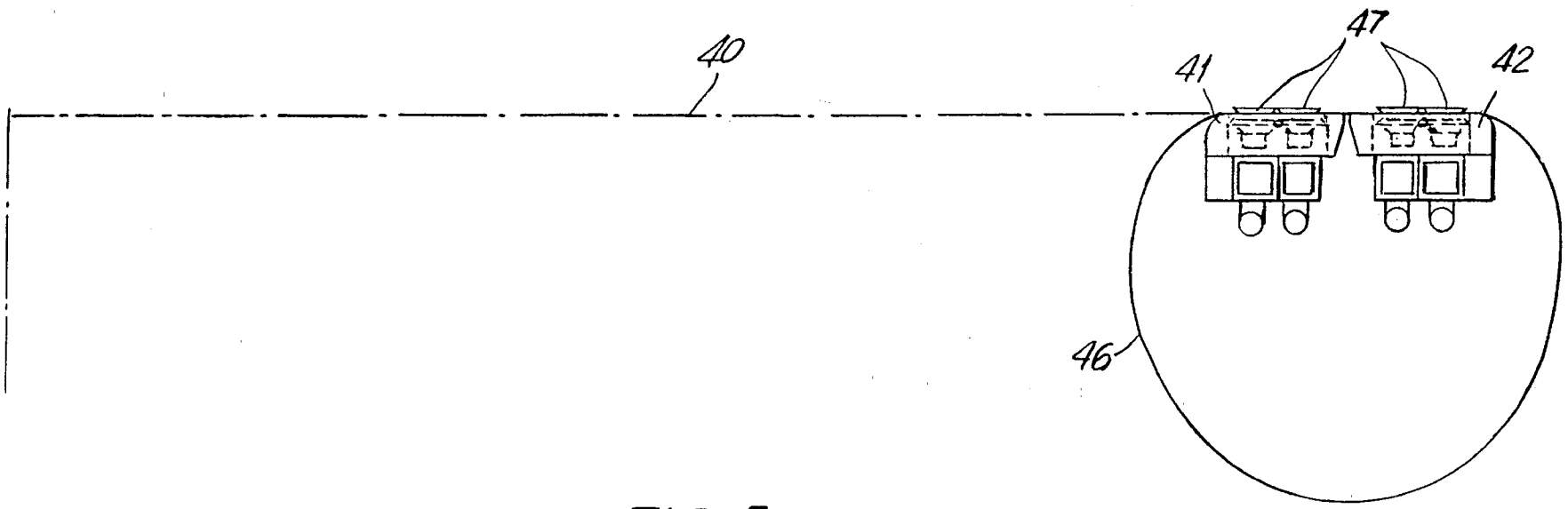
FIG. 5 is a third embodiment in which the clamping strips hold the tube from the inside after the tube is formed.
Figure 6:
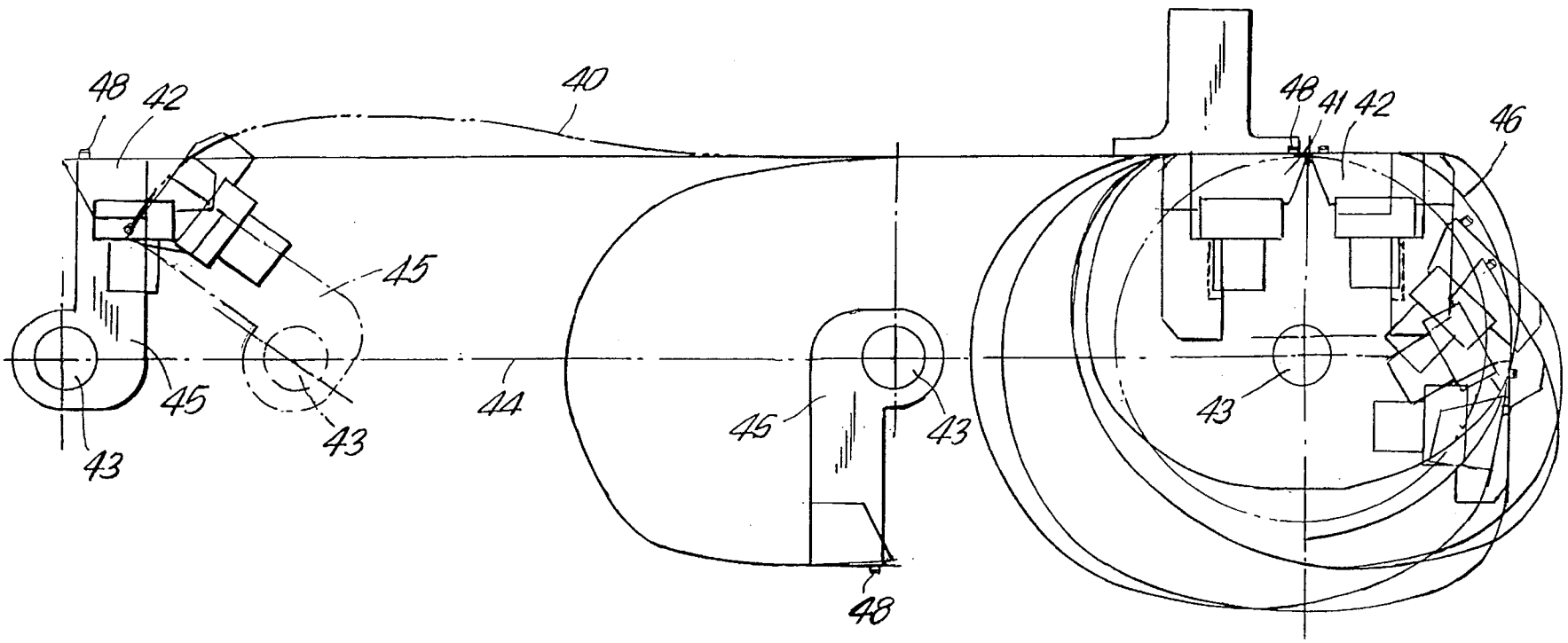
FIG. 6 illustrates the sequence of movements of the clamping strip provided for carrying out a rotation in the third embodiment example according to FIG. 5.

Another variant of a device according to the invention is shown in FIGS. 5 and 6. In this variant, a clamping strip 41 which is arranged so as to be stationary and a clamping strip 42 which sits on a lifting element 45 which is rotatable around an axle 43 and movable transversely along a sliding guide 44 are provided for the plate edges of the plate 40 (dashed lines) which are to be connected.

In the initial position, the two strips 41, 42 are arranged at a distance from another (FIG. 6) corresponding to the length of the plate 40 to be processed. The plate 40 can be fixed in exact register on the strips 41, 42 by means of the pin register 48 (already described) of the strips 41, 42 and the register hole system of the plate 40.

In order to form the tube, the lifting element 45 is rotated and, at the same time, displaced transversely in the direction of the stationary strip 41. In so doing, the lifting element 45 moves the stationary strip 41 downward and the strip 42 arranged thereon is located opposite the stationary strip 41 after a complete revolution so that the plate edges contact and can be connected or welded.

FIG. 6 also shows the sequence of movements of the plate edge which is rotated by 360°.

The drive of the axle 43 of the lifting element 45 can be effected by means of the drive, driving pinion and toothed rack in a manner similar to that of the cylinder 28 of the second embodiment described above.

The particular advantage of this variant is that the printing surface side of the plate 40 need hardly be touched while forming the tube, since the strips 41, 42 hold the plate edges on the inside of the tube 46 (FIG. 5).

In all of the embodiments, the clamping strips are constructed as suction strips with integrated adjustable vacuum suction members 47 (FIG. 5) which are distributed along the entire length at a slight distance from one another for holding the plate edges, since pre-treated aluminum plates are the most widely used type of printing form in offset printing.

When using plates which can be magnetized, e.g. plates of sheet steel, the clamping strips can be constructed as electric clamping magnet strips for a frictionally locking connection with the plate edges.

In this case, it is also conceivable to use optical scanning instead of the pin register and register hole system to ensure that the printing plate is fixed at the strips in exact register.

Although the terms "register hole system" and "pin register" were used in the embodiments, this may obviously be understood within the framework of the invention as any type of stops, markers or other auxiliary means which ensure a fastening and alignment of the plate edges at the strips in exact register and in the correct position.

When the plate edges are connected, the tube may be removed in the first two embodiments after lifting the clamping strips 5, 6 or 26, 27 off the cylinder 11 or 28 toward the open side by means of the lifting elements 4 or 24 of the holders 2, 3 or 20, 21 and, in the third embodiment, after cancelling the holding function of the strips 41, 42.

The invention is not limited by the embodiments described above which are presented as examples only but can be modified in various ways within the scope of protection defined by the appended patent claims.

We claim:

1. A device for producing a tube-shaped printing form with a continuous circumferential surface from a plate having a register hole system and a first edge and a second edge which are to be connected together, comprising: a first clamping strip which can be supported in an initial position and fastened longitudinally to the first plate edge; a second clamping strip which can be supported in an initial position and fastened longitudinally to the second plate edge, the clamping strips have a pin register with pins arranged to cooperate with the register hole system of the plate; means assigned to at least one of the clamping strips for effecting rotation around an axle parallel to a longitudinal axis of the tube, whereby the clamping strips are positionable opposite one another so that the plate edges contact one another in a correct register and can be connected together to form the tube; and a rotatably supported cylinder, a plurality of holders adapted to be positionable corresponding to plate size for holding the clamping strips at a distance from one another in the initial position approximately in one plane; a sliding table provided under the holders so as to support the plate; and lifting elements provided at the holders for lowering the two clamping strips on the plates whereby the plate edges to be connected can be fixed at the clamping strips by the pin register and the register hole system in exact register while simultaneously detaching from the holders, the second clamping strip being displaceable transversely along the sliding table at least along the length of the plate, while the first clamping strip, including the first plate edge fixed thereto, is positionable on the rotatably supported cylinder so that the plate is wrapped around the cylinder after a complete revolution of the cylinder, and so that the clamping strips are located opposite one another to facilitate connection of the plate edges, the plurality of holders including a holder arranged to position the second clamping strip, including the second plate edge fixed thereto, on the cylinder in a displaced position.

2. A device according to claim 1, wherein the second clamping strip is constructed as a carriage that can be pulled along the table in a slide guide and brought back into the initial position, respectively, and further comprising endless conveyor chain means guided via cam rollers for displacing the carriage.

3. A device according to claim 1, wherein the cylinder is adapted to have an adjustable diameter, and further comprising a connecting link operatively provided for adjusting the cylinder diameter.

4. A device according to claim 1, and further comprising sliding rail means for resiliently supporting the second clamping strip at both ends.

5. A device according to claim 1, and further comprising means for driving the cylinder, the cylinder being supported eccentrically relative to the cylinder driving means.

6. A device according to claim 1, wherein the cylinder has a flattened shoulder for positioning the plate edges.

7. A device according to claim 2, wherein the pins have a length, and the endless conveyor chain means is guided over the cylinder and is arranged at a distance from the cylinder that corresponds at least to the length of the pins.

8. A device for producing a tube-shaped printing form with a continuous circumferential surface from a flat plate having a register hole system and a first edge and a second edge which are to be connected together, comprising: a first clamping strip which can be supported in an initial position and fastened longitudinally to the first plate edge; a second clamping strip which can be supported in an initial position and fastened longitudinally to the second plate edge, the clamping strips have a pin register with a plurality of pins arranged to extend in a longitudinal direction of the tube-shaped form and to cooperate with the register hole system of the plate; means assigned to at least one of the clamping strips for effecting rotation around an axle parallel to a longitudinal axis of the tube whereby the clamping strips are positionable opposite one another so that the plate edges contact one another in a correct register and can be connected together to form the tube; a rotatably supported cylinder; holders, that can be positioned corresponding to plate size, for fastening the clamping strips at a distance from one another being held at the fixed clamping strips in exact register by means of the pin register and the register hole system; and lifting elements for positioning one of the strips, including the plate edge fastened thereto, on the rotatably supported cylinder at their holder while simultaneously detaching from the holder, while the other strip, including the plate edge held thereafter, remains at its holder, the cylinder being movable below and parallel to the plane in which the clamping strips are arranged in the initial position so that the latter moves the plate down and the plate is wrapped around the cylinder after a complete revolution of the cylinder, the clamping strips are located opposite one another for connecting the plate edges, and the second strip, including the plate edge fixed thereto, can be positioned on the cylinder in this position of the cylinder.

9. A device according to claim 8, wherein the plate has a length, the cylinder having a smaller circumference than the length of the plate.

10. A device according to claim 8, and further comprising a driving pinion and a toothed rack arranged and adapted to move the cylinder while the cylinder simultaneously rotates.

11. A device according to claim 8, and further comprising means for driving the cylinder, the cylinder being supported eccentrically relative to the cylinder driving means.

* * * * *